United States Patent [19]

Költer

[11] Patent Number: 4,546,235

[45] Date of Patent: Oct. 8, 1985

[54] DEVICE FOR MELTING AND DISPENSING A THERMOPLASTIC ADHESIVE

[75] Inventor: Martin Költer, Fürstenfeldbruck, Fed. Rep. of Germany

[73] Assignee: Hilti Aktiengesellschaft, Fürstentum, Liechtenstein

[21] Appl. No.: 374,528

[22] Filed: May 3, 1982

[51] Int. Cl.[4] ..... B67D 5/62; H05B 3/42

[52] U.S. Cl. ..... 219/230; 219/240; 219/241; 222/146.5

[58] Field of Search ..... 222/52, 54, 146.5; 219/230, 240, 241, 242, 250; 401/1, 2

[56] References Cited

U.S. PATENT DOCUMENTS

| | | | |
|---|---|---|---|
| 1,407,722 | 2/1922 | Braun | 219/240 |
| 1,430,830 | 10/1922 | Morgan | 219/250 X |
| 2,570,762 | 10/1951 | Caliri | 219/240 X |
| 2,789,198 | 4/1957 | Dye et al. | 219/240 X |
| 3,604,597 | 9/1971 | Pohl | 222/146 HE |
| 4,059,204 | 11/1977 | Duncan et al. | 222/146 HE |
| 4,150,770 | 4/1979 | Wieland et al. | 222/146 HE |

*Primary Examiner*—F. J. Bartuska
*Attorney, Agent, or Firm*—Toren, McGeady Stanger, Goldberg & Kiel

[57] ABSTRACT

In a device for melting and dispensing measured amounts of a thermoplastic adhesive, the adhesive is melted in a housing having a handle with a pistol-like grip. Two separate heating stages are provided in the housing, a higher temperature heating stage for use during operation and a lower temperature heating stage effective when the operation of the device is temporarily interrupted. A control member, such as a sensor, is provided in the handle so that when it is gripped by an operator, and the device is connected to a power supply, the sensor switches over to the higher temperature heating stage. With the device connected to the power supply, but the handle and the sensor not gripped by the operator, only the lower temperture heating stage is effected. If there is a temporary interruption in use, and the handle is released, the sensor effects a changeover from the higher temperature heating stage to the lower temperature heating stage.

3 Claims, 2 Drawing Figures

DEVICE FOR MELTING AND DISPENSING A THERMOPLASTIC ADHESIVE

SUMMARY OF THE INVENTION

The present invention is directed to a device for the melting and measured dispensing of a thermoplastic adhesive where the device includes a housing containing a handle with at least two separate controllable heating stages located within the housing.

There has been an increased use of thermoplastic adhesives in the fastening art. The advantages of such adhesives include a rapid loading capacity, lack of volatile solvents or solvents which are damaging to the health, and there is the capability that a connection effected with such adhesives can be broken by heating the connection. In addition to manufacturing processes where the adhesive is used for securing parts together, such as in the shoe industry, fusion adhesion can also be effected in the assembling of parts. In such procedures there is the problem that relatively long interruptions may take place between the individual applications of the adhesive material. If the device is turned off during such interruptions, the heat required to keep the adhesive molten is lost and a relatively long start-up period is required until the device again reaches its operating temperature.

In a known device, heating up the adhesive to the operational temperature is effected in two stages. Initially, heating takes place to a certain temperature employing a higher stage. Once that certain temperature is reacted, then a switching operation occurs via thermal circuit components and a lower temperature heating stage becomes effective providing only the melting heat needed for the discharge of the adhesive.

If there is no discharge of the melted adhesive for a long period, there is the danger that the device, maintained at the melting temperature, might overheat. To prevent overheating, the device must be turned off when a long interruption in use is expected. The operator must decide each time whether the interruption will be long or short, so that, if necessary, the device can be turned off. Often, such a determination is difficult to make and it involves additional work for the operator. If the device is turned off more often than is necessary, then unnecessary heating up periods result. On the other hand, if the device is shut off too seldom or not at all, there is the danger of overheating. In the past it has been known to use an over-temperature protector for the heating elements used in the melting of the adhesive. At a selected over-temperature level the supply circuit is permanently opened and the device no longer functions until it is repaired. In such a situation, a long down time may be involved interfering with the operations in which the device is employed.

Therefore, it is the primary object of the present invention to provide a device for melting thermoplastic adhesive so that the device does not overheat or cool down too much during interruptions in its normal use. When the device is connected to its power supply, the thermoplastic adhesive is maintained at a temperature close to but below the melting temperature so that it can be quickly brought to the melting temperature.

In accordance with the present invention, the device includes control means located in a pistol grip-like handle so that with the device coupled to an appropriate power source, and with the handle free from the grip of the operator, the higher temperature heating stage is cut out while the lower temperature heating state remains effective.

When using the device embodying the present invention, the operator is relieved of any decision whether to switch the device off during interruptions in its use. Another significant advantage is that the device does not completely cool off, rather it continues to be maintained at a lower temperature not damaging to the adhesive material or to the structural parts of the device. Consequently, when the device is to be utilized for dispensing adhesive, the time required to bring the adhesive up to the necessary molten temperature is very short.

Basically, any conventional electrical circuit components, such as switches, pressure members or the like can be utilized for changing over between the two heating stages. Since such components usually have projecting parts and are subject to mechanical wear, it is advantageous to locate the sensor in the handle of the device so that it reacts to the operator's touch during normal operation. Accordingly, switching between the heating stages occurs when the operator's hand contacts or releases the handle. By merely touching two components of the sensor the higher temperature required for melting the adhesive is generated and when the components are released the amount of heat developed involves a lower temperature. Sensors of the type usable with the device are employed at the present time in electronic games and, therefore, are very economical parts.

During normal working operations with a device applying melted thermoplastic adhesives, often only short interruptions are encountered such as when a part must be placed in a certain position. To effect such a positioning, the device may be placed aside for a short period. In such a situation, to avoid a changeover between the heating stages, it is practical if the higher temperature remains in effect for a certain period of time with the changeover to the lower temperature heating stage taking place only with a time delay. In this way, unnecessary waiting time for bringing the device back up to the necessary temperature level can be avoided.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
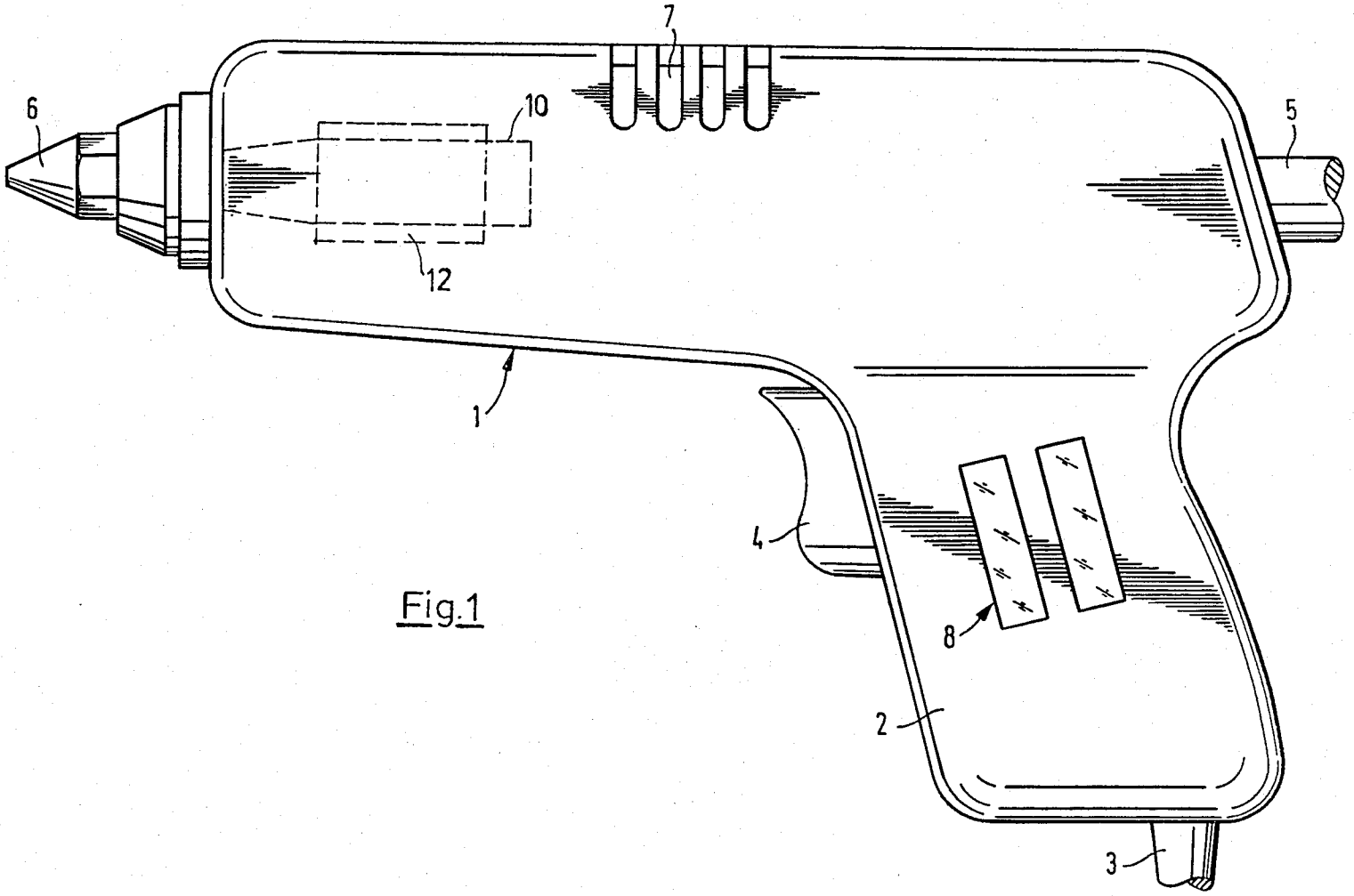
FIG. 1 is a side elevational view of a device embodying the present invention.
Figure 2:
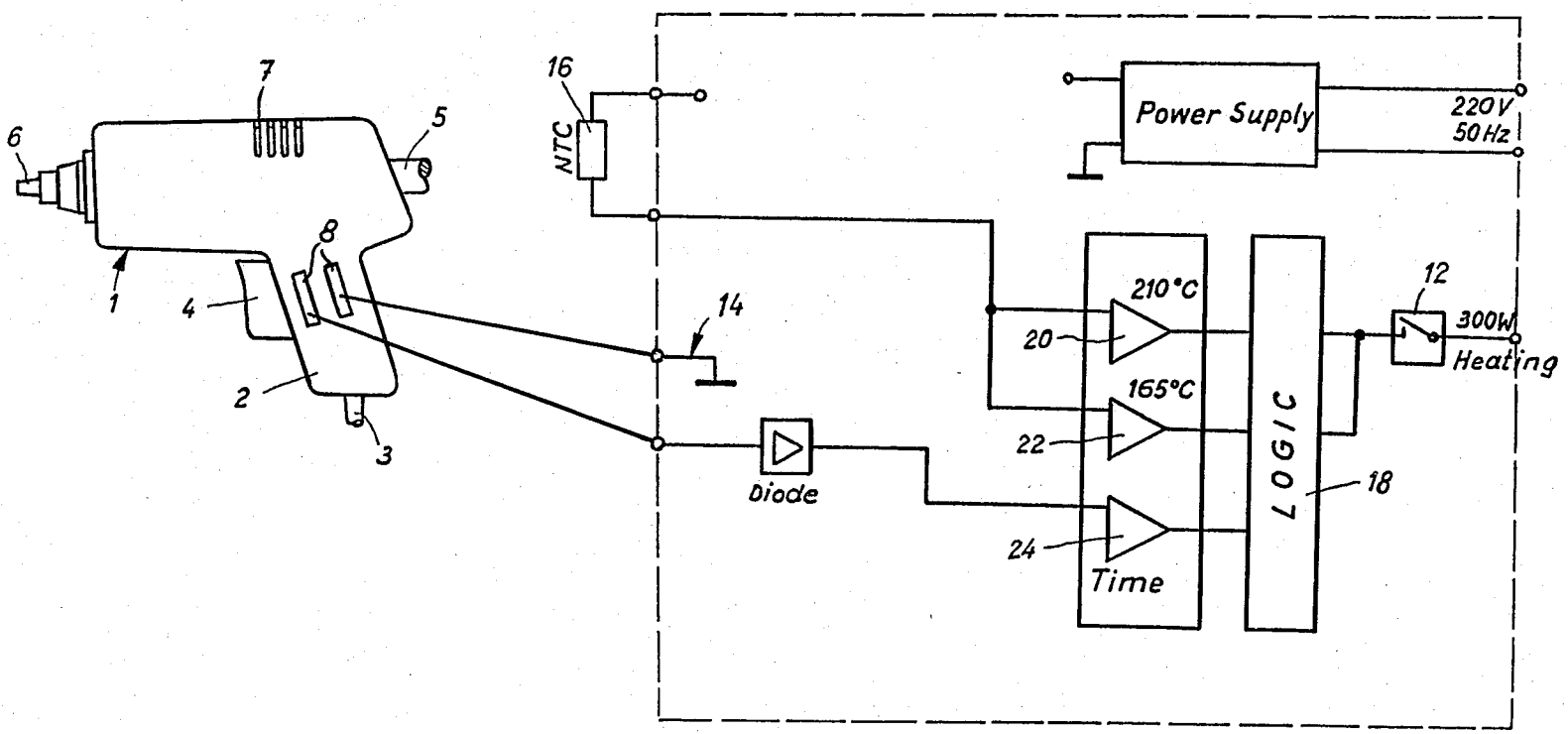
FIG. 2 is a schematic showing of the device and the circuitry used in its operation.

In FIG. 1 a device for melting a thermoplastic adhesive and for dispensing measured amounts of the melted adhesive includes a housing 1 with a handle 2 affording a pistol-like grip. Handle 2 extends downwardly from one end of the housing. An electric supply line 3 is connected to the handle 2 for supplying electrical power to a circuit located within the housing 1, such as shown FIG. 2. For purposes of clarity the circuit within the housing 1 is shown as a separate unit in FIG. 2. Though not shown, an off-on switch can be included in the housing 1 or in the line 3 extending to the housing for supplying the electrical power required to melt the thermoplastic adhesive.

A pressure actuated trigger member 4 is located in the handle 2. If the thermoplastic adhesive is heated to the required molten temperature, when the trigger member 4 is pressed inwardly, a body 5 of the adhesive material, in the form of an elongated cylindrical rod, is conveyed by a transport device, known per se and not shown, into a melting chamber 10 shown in dashed lines. As the cylindrical rod of adhesive material is moved forwardly into the housing 1 toward an output nozzle 6, the melted adhesive is pressed out through the nozzle. In the top of the housing 1, away from the handle 2, ventilation slots 7 are arranged for cooling the device.

In the side of the handle there is a two-part sensor 8 which forms a part of the electrical circuit for the device. The sensor 8 is located in the handle so that it is contacted by the hand of the operator when he grips the device for operation. It can be appreciated, that when the operator grips the handle 2, his hand presses inwardly against the two-part sensor 8.

As shown in dashed lines in FIG. 1, a heater element 12 encircles the melting chamber 10 for supplying the necessary amount of heat to melt the solid thermoplastic adhesive in the body 5 so that it can be dispensed outwardly through the nozzle 6. The electrical circuitry is arranged to supply the necessary electrical power to the heating element 12 so that two different heating stages can be effected.

In the circuitry the two-component sensor 8 is connected to a switch 14. With power being supplied to the device through an on-off switch 16 under normal conditions when the operator is not gripping the handle 2 and applying pressure to the sensor 8 only sufficient power is supplied to the heater element 12 to raise the temperature of the thermoplastic adhesive to 165° C. The circuitry includes a logic element 18 which is arranged, based on the signals it receives from the components 20, 22 and 24, to supply the selected electrical power for the controlled heating of the adhesive within the melting chamber 10. With the power supply connected to the device, the logic element 18 is arranged to supply sufficient power to the heating element 12 so that the adhesive is heated to approximately 165° C. At this particular temperature the adhesive is close to the molten or melted state, but it is sufficiently below the melting temperature so that the various parts of the device are not subject to being overheated.

When the device is to be used for dispensing the melted adhesive, the operator grasps the handle so that his hand presses against the two-component sensor closing the switch 14 and activating the component 20 which signals the logic element 18 to change the amount of power supplied to the heating element 12 so that the adhesive can be heated to 210° C. whereby it is in the molten state. As long as the operator continues to grasp the handle and depress the sensor 8, the heating element 12 is kept at the higher level so that the adhesive is in the melted condition and can be discharged by pressing the trigger 4. Each time the trigger 4 is pressed inwardly a measured amount of the adhesive is dispensed through the nozzle 6 and a comparable amount of the solid material is pressed into the inlet end of the melting chamber 10. As long as the operator continues to hold the handle, the device is ready to dispense the adhesive.

If for some reason the operator has to release the handle and place the device on a supporting surface, such as a work table, he releases the sensor 8 which opens the switch 14 breaking the connection to the component 20, however, the signal from the component 22 continues to be conveyed to the logic element 18 so that the logic element provides the necessary power to maintain the temperature in the melting chamber at the 165° C. level. As long as the power supply to the device is maintained, the melting chamber is kept at 165° C. if the operator does not grasp the handle and depress the sensor 8.

It is possible, during the various operations required for connecting parts by means of the melted thermoplastic adhesive, that the operator may have to place the device on a support surface for a brief period of time to perform another step of the adhesive connecting operation. If the operator, releases the handle for a short period only and then continues dispensing the adhesive, it is not necessary to change over to the lower operating temperature. As a matter of fact, because of the short period involved, any changeover involving a drop in temperature would tend to lengthen the time involved in carrying out the connecting operations.

Accordingly, the circuitry connecting the sensor 8 to the logic 18 includes a time delay so that when the sensor is released the changeover in the supply of electrical power to the heater does not take place for a predetermined period or delay. When the sensor is released a signal is supplied through the component 24 to the logic element 18 and the power supply changeover takes place only after a given time delay. Such time delays are well known in electrical circuitry and the time period involved can be selected based on the operating conditions of the device. In other words, if one of the work operations requires the operator to release the handle for a period of 15 seconds, before he picks up the handle again and continues dispensing the adhesive, the logic element or control will not change over to the reduced power supply until the given time period has elapsed. In this way, the operator can pick up the device and immediately commence dispensing the adhesive without waiting for the melting chamber to be heated to the required level.

Though not shown in the drawing, some form of signal would be provided on the device to indicate that it is connected to the power supply and that it is ready for operation. Such signals are conventional and can be provided in the form of lamps in the housing.

In the above description the temperature levels used are merely provided by way of example and are not indicated as a limitation on the temperature levels at which the device can be operated. The temperature conditions are concerned with the particular thermoplastic adhesive being used. The difference in temperature between the lower heating stage and the higher heating stage is selected so that the time period required to melt the thermoplastic adhesive is kept at a minimum. Further, the arrangement of the circuitry is also provided by way of example, since persons skilled in the art would appreciate that a variety of electrical circuitry components could be used to achieve the same result.

While specific embodiments of the invention have been shown and described in detail to illustrate the application of the inventive principles, it will be understood that the invention may be embodied otherwise without departing from such principles.

I claim:

1. Device for melting thermoplastic adhesive and for the measured discharge of the melted adhesive including a housing within which the adhesive is heated and from which it is discharged, said housing having an outwardly extending pistol-like handle, a melting chamber within said housing, a heater element encircling said melting chamber and including at least two controllable heating stages for heating the adhesive including a higher temperature heating stage for use when the device is operating for adequately melting and discharging the melted adhesive and a lower temperature heating stage for heating the thermoplastic adhesive to a temperature so that the higher heating stage quickly raises the temperature of the melted adhesive whereby it is ready for use, wherein the improvement comprises means for supplying power to said device so that said lower temperature heating stage is actuated when power is supplied to said device, a pressure actuated trigger member positioned in said pistol-like handle for supplying a measured amount of adhesive to be heated into said melting chamber and for discharging a measured amount of heated adhesive from said melting chamber, control means located in said handle and operable separately from said trigger member for switching to the higher temperature heating stage when said handle is gripped for carrying out the operation of said pressure actuated trigger member and for switching from the higher temperature heating stage to the lower tempterature heating stage when said handle is released during a temporary interruption in the use of the device, said control means being positioned on the surface of said handle spaced from said trigger member so that said control means are contacted by the hand of the person operating said device when the hand grips said handle in a position ready to operate said trigger member, and said control means includes a delay for delaying the switching from the higher temperature heating stage to the lower temperature heating stage when said control means are released as said handle of the device is released by the person operating said device.

2. Device, as set forth in claim 1, wherein said handle has a first side with said trigger member mounted in and extending outwardly from said first side, and a pair of second sides extending transversely of said first side and said control means mounted in the surface of one of said second sides.

3. Device, as set forth in claim 2, wherein said control means comprises a two-part sensor positioned on one of said second sides so that the two-part sensor is gripped by the person operating said device in position ready to operate said trigger member.

* * * * *